US009522568B2

(12) United States Patent
Abernethy, Jr.

(10) Patent No.: US 9,522,568 B2
(45) Date of Patent: Dec. 20, 2016

(54) PAINT CAN SAVER APPARATUS

(71) Applicant: Claremont Products, LLC, Claremont, NC (US)

(72) Inventor: Joseph M. Abernethy, Jr., Claremont, NC (US)

(73) Assignee: Claremont Products, LLC, Claremont, NC (US)

( * ) Notice: Subject to any disclaimer, the term of this patent is extended or adjusted under 35 U.S.C. 154(b) by 0 days.

(21) Appl. No.: 14/665,280

(22) Filed: Mar. 23, 2015

(65) Prior Publication Data

US 2015/0266337 A1 Sep. 24, 2015

Related U.S. Application Data

(60) Provisional application No. 61/969,318, filed on Mar. 24, 2014.

(51) Int. Cl.
*B44D 3/12* (2006.01)
*B65D 25/48* (2006.01)

(52) U.S. Cl.
CPC ..... *B44D 3/128* (2013.01); *B65D 25/48* (2013.01)

(58) Field of Classification Search
CPC ..... B44D 3/128; B65D 25/48
USPC ..... 222/567, 570
See application file for complete search history.

(56) References Cited

U.S. PATENT DOCUMENTS

| | | | | | |
|---|---|---|---|---|---|
| 2,786,614 | A * | 3/1957 | Giusto | B65D 25/48 | 220/697 |
| 3,221,955 | A * | 12/1965 | Banaszak | B65D 25/48 | 220/701 |
| 4,009,802 | A * | 3/1977 | Hayduchok | B44D 3/128 | 220/697 |
| 4,203,537 | A * | 5/1980 | McAlister | B65D 25/20 | 220/675 |
| 4,911,319 | A * | 3/1990 | DeJean | B65D 25/48 | 220/700 |
| 5,172,822 | A * | 12/1992 | DeFrance | B44D 3/127 | 220/733 |
| 5,641,089 | A * | 6/1997 | Palank | B44D 3/128 | 220/701 |
| 8,757,453 | B1 * | 6/2014 | Olsson | B65D 25/48 | 220/700 |
| 2006/0175362 | A1 * | 8/2006 | Gringer | B44D 3/127 | 222/570 |

* cited by examiner

*Primary Examiner* — Donnell Long
(74) *Attorney, Agent, or Firm* — Shumaker, Loop & Kendrick, LLP

(57) ABSTRACT

The invention is a paint can rim protector for protecting the rim of a paint can from infiltration of paint during painting or during the pouring of paint. The invention includes a rim engagement member for attaching the paint rim protector to the rim of a paint can. The rim engagement member may be in the form of a circular tab which engages a groove of the paint can rim or it may be an outer wall which snaps around an outer edge of a paint can rim. The invention includes a top flat surface which is inclined downwards towards the center of the paint can and which cantilevers over the inner edge of the rim of the paint can to form a scrape edge. The invention also includes a spout attached to the topside of the top surface.

2 Claims, 6 Drawing Sheets

PAINT CAN SAVER APPARATUS

CROSS REFERENCE TO RELATED APPLICATIONS

This application is a non-provisional of, claims priority to and benefit of, and incorporates by reference the entirety of U.S. Provisional Patent Application having Ser. No. 61/969,318 filed on Mar. 24, 2014.

TECHNICAL FIELD AND BACKGROUND OF INVENTION

The invention relates to the field of containers for storing liquids. More particularly, the invention relates to the field of attachments for containers having a removable lid for storing liquids such as paint.

Liquids may be stored in a variety of containers. In the visual art and construction industries, it is common for liquids to be stored in cans of various sizes. Various paints, stains, varnishes, urethanes, compounds, waxes, glues, epoxies, oils, and petroleum products, among other liquids, powders, and pastes, may be sold in and/or stored in metal or plastic cans which have a removable lid. For purposes of the present application, all such products are referred to as "paint" and their containers as "paint cans." The various sizes of paint cans may include ¼ pint, ½ pint, pint, quart, ½ gallon, gallon, 3 gallon, and 5 gallon sizes among others and units.

Paint cans typically have an integrated internal rim located at a top portion of the can. The internal rim of a paint can typically cantilevers from the wall of the can towards the center of the can. The rim of the paint can may have an outer projection which extends outward from the wall of the paint can. The internal rim typically includes one or two grooves or valleys in concentric circles around the upper perimeter of the cylindrical paint can. If the can has two grooves, typically one of the grooves is deeper than the other. The grooves in the rim of the paint can form a channel for the purposes of securing the paint can lid to the paint can for longer term storage. The paint can lid typically has a circular ridge which tightly meshes with groove of the paint can lid. Typically the ridge is slightly larger than the groove so that a painter must exert a force, as with a mallet or hand, to secure the lid to the can. Forcefully securing the lid to the can via the ridge into the groove effectively seals the paint can.

It is common in the industry of visual arts and construction for painters to utilize the paint can not only for longer term storage but also as a temporary storage vessel while engaging in painting. That is, painters commonly dip a paint brush or other implement into the paint can and then apply paint from the brush or implement to a wall or other material. During such a process, the painter will typically scrape the brush or other implement against the internal rim of the paint can so as to remove an excess quantity of paint and achieve a desired level of paint on the implement. During this process, it is very common for the excess paint to become lodged in the groove of the rim of the paint can. This is problematic for several reasons. First, paint that remains in the groove may become hardened and thus wasted. Second, the paint that remains in the groove may reduce the effectiveness of seal between the lid and the paint can. Third, the paint that remains in the groove may lead to unplanned spills of paint thus damaging areas of the environment in which the painter did not intend to apply paint. For instance, when applying the paint can lid where paint has been lodged in the grove, the applying of pressure to seal the lid will cause the paint to "splatter."

Even if a painter does not utilize the can as a storage vessel during painting, and, instead, pours the paint into another container, such as a pan for the rolling on of paint, residual paint may become lodged in the rim of the can through the pouring action. Such residual paint remains problematic for all of the reasons stated above including the tendency of the paint to drip down the edge of the can leading to mess and additional paint waste.

Thus, there is a need in the art for a device which may be attached to the rim of a paint can that prevents paint from entering the grooves of the rim of a paint can when the paint can is utilized as a storage vessel during painting. Additionally, there is a need in the art for a device which may be attached to the rim of a paint can that prevents paint from entering the grooves of the rim of a paint can when paint is poured from the paint can into another vessel. Similarly, there is a need in the art for a single device that may be attached to the rim of a paint can that prevents paint from entering the grooves of the rim of a paint can whether paint is poured from the can or the can is utilized as a storage vessel during painting.

SUMMARY OF THE INVENTION

The present invention is thus a paint can rim protector that prevents paint from entering the grooves of the rim of a paint can whether paint is poured from the can or the can is utilized as a storage vessel during painting. The paint can rim protector is designed to provide protection to the rim of the paint can so that paint does not enter the rim and so that the rim remains clean for application of the paint can lid. As such, the paint can rim protector may prevent paint from entering the rim of a paint can. The paint can rim of the present invention contemplates use on a variety of different paint can rim profiles, diameters, and shapes.

The paint can rim protector of the present invention includes a scrape edge for scraping excess paint from a painting implement such as a brush. This scrape edge is especially useful in protecting the paint can rim when the paint can is utilized as a temporary storage vessel during painting. The paint can rim protector of the present invention also includes at least one spout for pouring paint from paint can into a second container. This spout is especially useful for helping protect the paint can rim when the paint can is utilized as a longer term storage vessel from which paint is poured into another vessel.

According to one embodiment of the invention, the paint can rim protector is made from plastic such as polypropylene. However, the paint can rim protector may be made of metal or another material. In embodiments where the paint can rim protector is made from plastic, the protector may be molded or extruded. The paint can rim protector of the present invention may be thus be made from a variety of materials and is compatible with paint cans made from a variety of materials.

According to another embodiment of the invention, the paint can rim protector includes a rim engagement member for engaging the rim of a paint can and for securing the paint can rim protector to the rim of the paint can. The rim engagement member removably but securely attaches the paint can rim protector to a paint can—preferably by "snapping" the paint can rim protector to the rim of a paint can.

According to another embodiment of the invention, a substantially smooth, flat top surface is attached to the paint can rim protector. The top surface extends/cantilevers over the inner edge of the paint can rim towards the center of the paint can. The cantilever portion of the smooth top surface forms a scrape edge for scraping paint from a painting implement such as a paint brush. This scrape edge may form a complete circle about the inner edge of the paint can rim protector.

According to another embodiment of the invention, the top smooth surface is inclined downwards toward a center of the paint can when the protector is installed on a rim of a paint can. This angle of in inclination allows excess paint, by the force of gravity, to drip towards the internal cavity of the paint can.

According to another embodiment of the invention, a spout is attached to the smooth top surface of the paint can rim protector. The spout includes an indent in the top surface of the paint can rim protector and an angled channel to channel paint being poured from the paint can to another storage vessel.

According to another embodiment of the invention, the rim engagement member includes a circular tab extending downward from the smooth to surface. The circular tab is sized to fit snuggly into the deepest channel of the paint can rim.

According to another embodiment of the invention, the rim engagement member includes an outer wall that snaps around an outer projection of a paint can rim. The outer wall of the rim engagement member may have a hook which secures underneath the outer projection of the paint can rim.

According to another embodiment of the invention, the rim engagement member may include both a circular tab and also an outer wall—both functioning to removeably secure the paint can rim protector to the paint can rim.

BRIEF DESCRIPTION OF THE DRAWINGS FIGURES

Features, aspects, and advantages of a preferred embodiment of the invention are better understood when the detailed description is read with reference to the accompanying drawing, in which.

DETAILED DESCRIPTION

It is to be understood by a person having ordinary skill in the art that the present discussion is a description of exemplary embodiments only and is not intended as limiting the broader aspects of the present invention. The following example is provided to further illustrate the invention and is not to be construed to unduly limit the scope of the invention.

Figure 1:
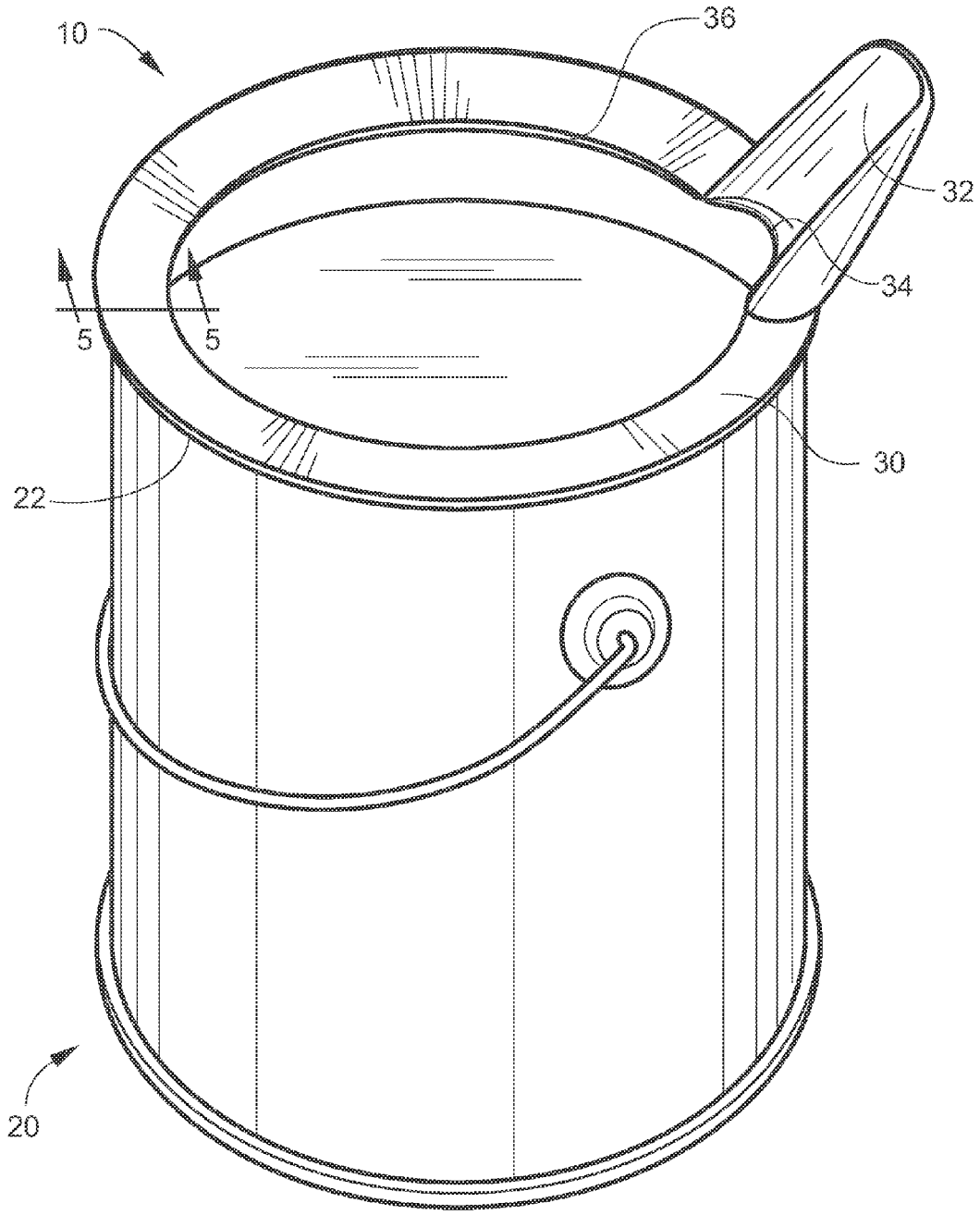
FIG. 1 is a perspective view of an embodiment of the paint can rim protector of the present invention installed on a paint can rim.
Figure 2:
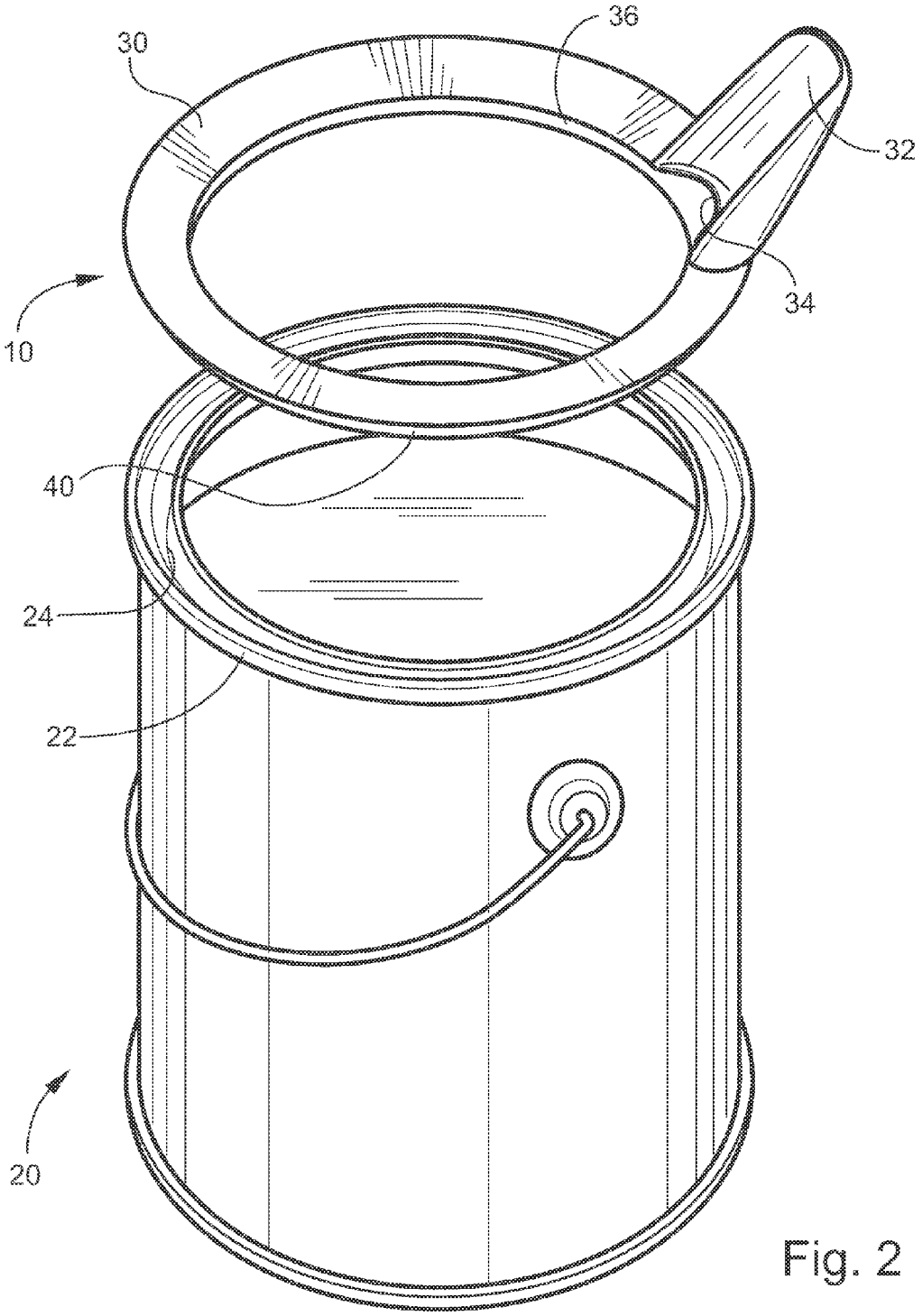
FIG. 2 is an exploded view of an embodiment of the paint can rim protector of the present invention.
Figure 5:
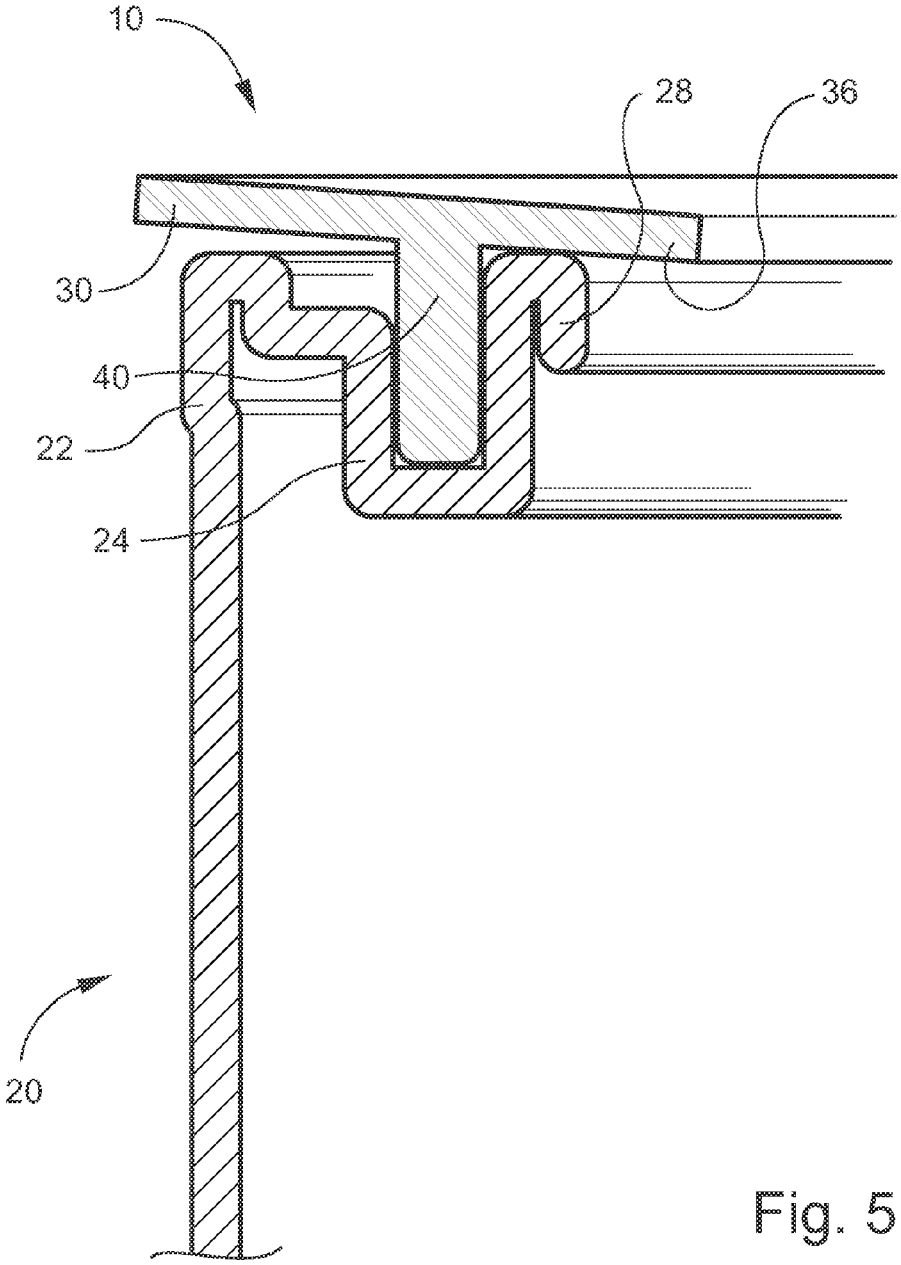
FIG. 5 is a partial cross-sectional view of FIG. 1 at line 5-5.

Referring now specifically to the drawings, FIGS. 1, 2, and 5 show an embodiment of the invention 10 that utilizes a circular tab 40 as the rim engagement member to secure the paint can rim protector 10 to the paint can 20. The circular tab 40 extends from a smooth flat top surface 30 of the paint can rim protector 10. The circular tab 40 is sized to fit snuggly but removably inside the groove 24 of the rim 22 of the paint can 20. The smooth flat top surface 30 of the paint can rim protector 10 is inclined at an angle toward the center of the paint can 20 as can best be seen in FIG. 5. The smooth flat surface 30 of the paint can rim protector 10 has a scrape edge 36 which cantilevers over the inner edge 28 of the rim 22 of the paint can 20.

As can be seen in FIGS. 1 and 2, the paint can rim protector 10 includes a channeled spout 32. The channeled spout 32 may be utilized to channel paint poured from the paint can 20 when the paint can rim protector 10 is attached to the paint can 20. The channeled spout 32 includes an indent 34 in the smooth flat top surface 30 to accommodate and facilitate the pouring of paint from the paint can 20.

Figure 3:
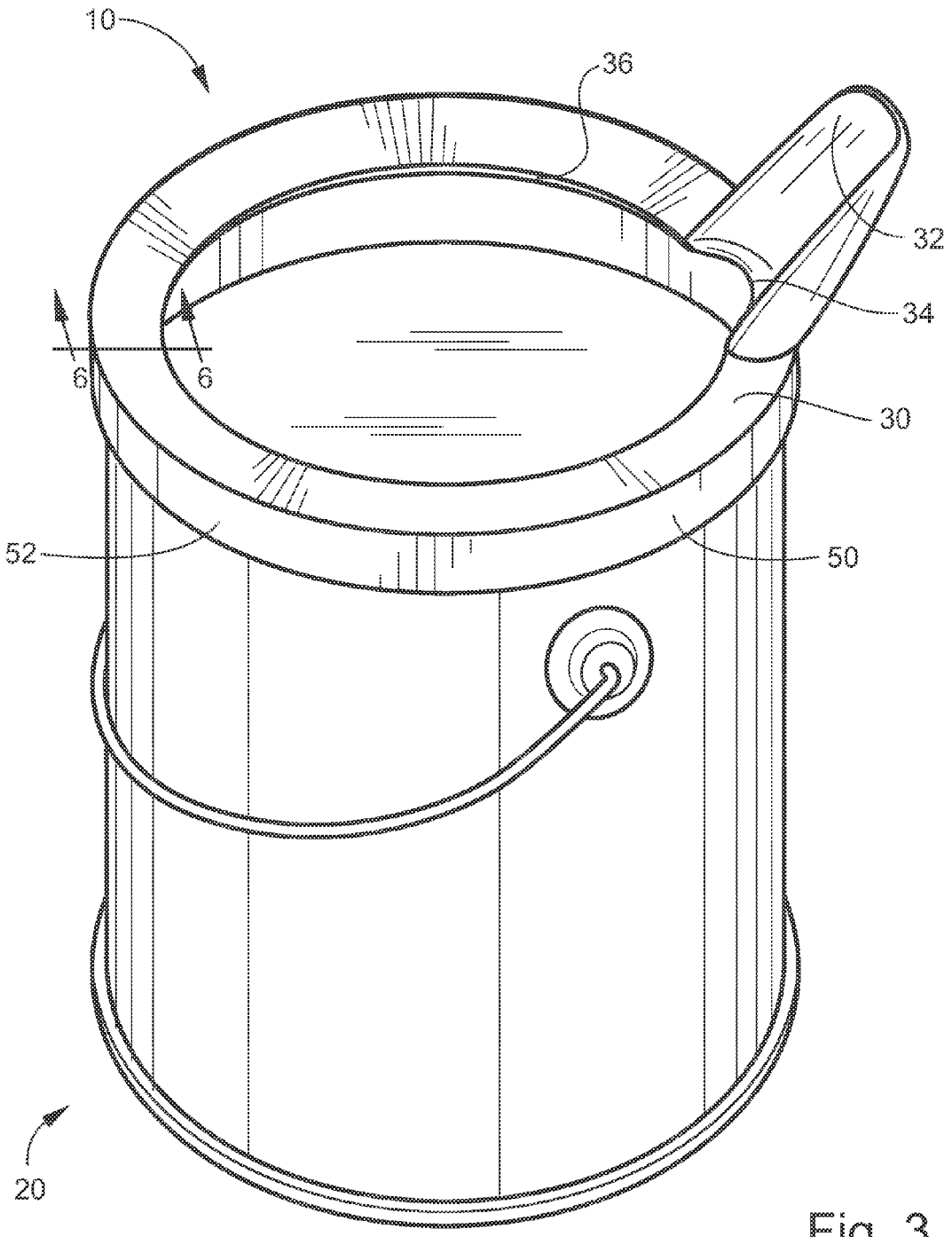
FIG. 3 is a perspective view of an embodiment of the paint can rim protector of the present invention installed on a paint can rim.
Figure 4:
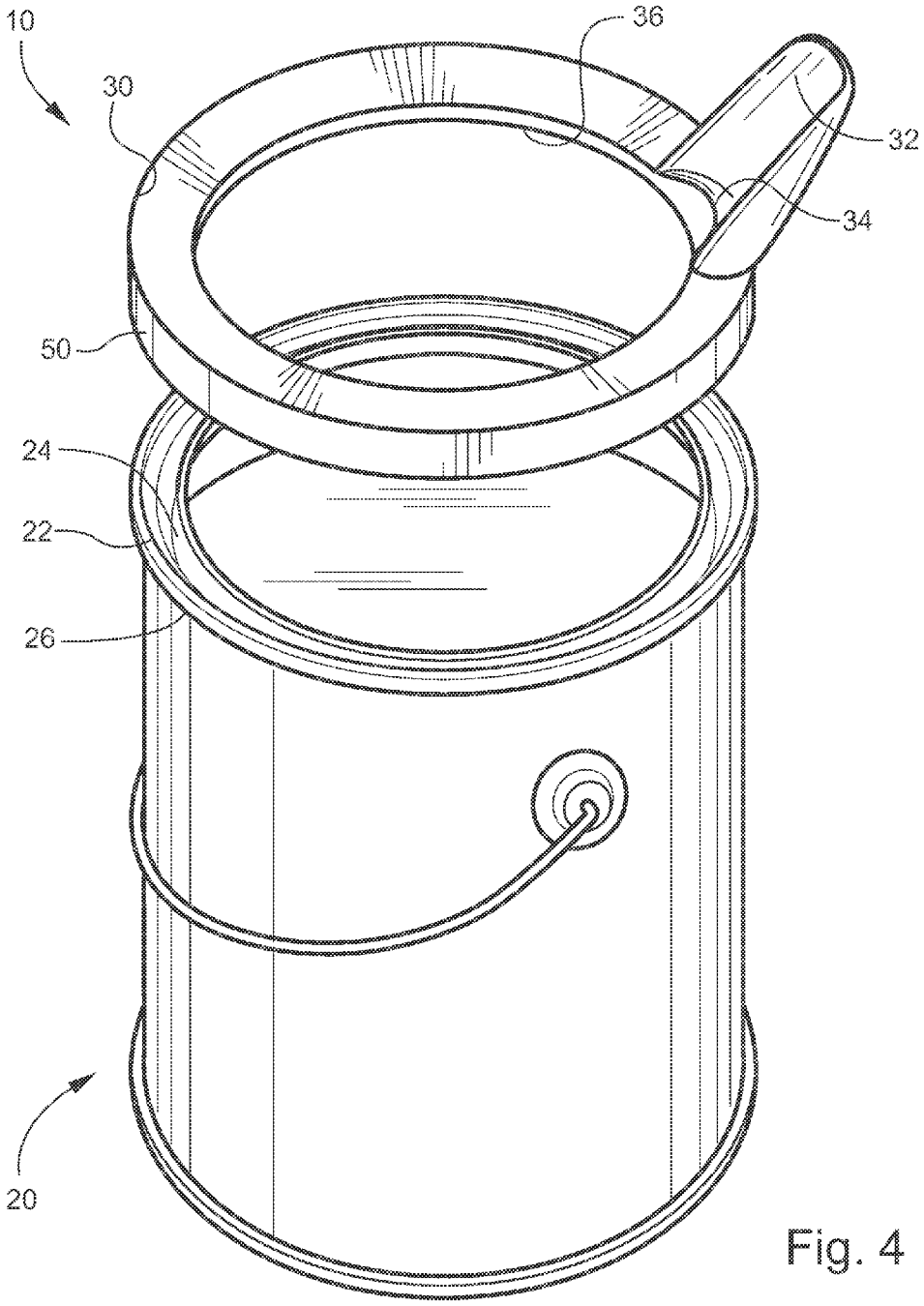
FIG. 4 is an exploded view of an embodiment of the paint can rim protector of the present invention.
Figure 6:
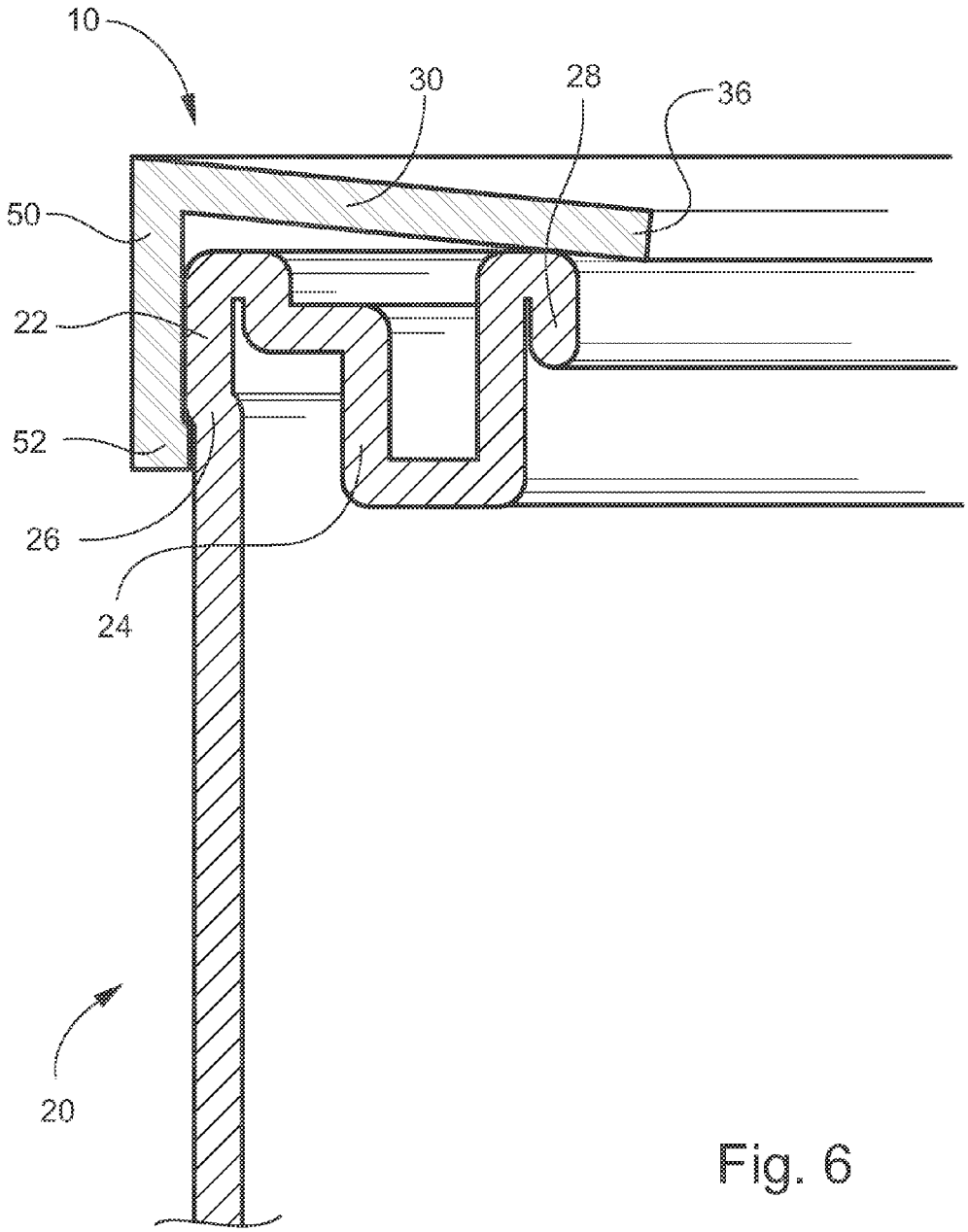
FIG. 6 is a partial cross-sectional view of FIG. 3 at line 6-6.

Referring now specifically to FIGS. 3, 4, and 6, an embodiment of the invention 10 is shown that utilizes an outer wall 50 as the rim engagement member to snap around an outer projection 26 of the paint can rim 22 of the paint can 20. The outer wall 50 includes a hook portion 52 which laps over the outer projection 26 of the paint can rim 22 of the paint can 20. The outer wall 50 and its hook portion 52 are sized to fit snuggly but removably around the rim 22 and specifically the outer projection 26 of the rim 22 of the paint can 20. The smooth flat top surface 30 of the paint can rim protector 10 is inclined at an angle toward the center of the paint can 20 as can best be seen in FIG. 6. The smooth flat surface 30 of the paint can rim protector 10 has a scrape edge 36 which cantilevers over the inner edge 28 of the rim 22 of the paint can 20.

As can be seen in FIGS. 3 and 4, this embodiment of the paint can rim protector 10 also includes a channeled spout 32. The channeled spout 32 may be utilized to channel paint poured from the paint can 20 when the paint can rim protector 10 is attached to the paint can 20. The channeled spout 32 includes an indent 34 in the smooth flat top surface 30 to accommodate and facilitate the pouring of paint from the paint can 20.

A paint can rim apparatus has been described above. Various details of the invention may be changed without departing from the scope of the invention. Furthermore, the foregoing description of the preferred embodiment of the invention and best mode for practicing the invention are provided for the purpose of illustration only and not for the purpose of limitation.

I claim:

1. A paint can rim protector for protecting and securely and removably attaching to a rim of a paint can comprising:

a. a top surface which is flat, smooth, and inclined towards the center of the paint can;

b. a scrape edge disposed at an inner edge of the top surface which cantilevers over an inner edge of the rim of the paint can;

c. a rim engagement member attached to the underside of the top surface for engaging the rim of the paint can; and d. a spout attached to the topside of the top surface for pouring paint;

e. an indent having a concaved shape formed in the spout to accommodate and facilitate the pouring of a quantity of paint from the paint can via the spout;

f. wherein the rim engagement member comprises a circular tab that fits snuggly in a groove of the rim of the paint can for securing the paint can rim protector to the rim of the paint can;

g. wherein the paint can rim protector is characterized by a lack of any outer wall for securing the paint can rim protector to the paint can; and h. wherein the paint can rim protector is made from polypropylene.

2. The paint can rim protector of claim 1 wherein the smooth flat surface and the scrape edge form a complete circle around the circumference of the paint can.

* * * * *